United States Patent [19]

Spanski

[11] Patent Number: 4,890,846

[45] Date of Patent: Jan. 2, 1990

[54] TOY FOR BALL GAME

[76] Inventor: Boguslaw M. Spanski, 2565 Robinson St., Mississauga, Ontario, Canada, L5C 2P5

[21] Appl. No.: 364,852

[22] Filed: Jun. 12, 1989

[51] Int. Cl.[4] ..... A63B 67/00

[52] U.S. Cl. ..... 273/324

[58] Field of Search ..... 273/317, 318, 323, 324, 273/1 GE, 26 C

[56] References Cited

U.S. PATENT DOCUMENTS 2,930,618 3/1960 Glintz ..... 273/323

3,061,311 10/1962 Von Arnhem ..... 273/323

3,169,019 2/1965 Genjack ..... 273/26 C 4,679,799 7/1987 Coletti ..... 273/318

*Primary Examiner*—William H. Grieb

*Attorney, Agent, or Firm*—Krass & Young

[57] ABSTRACT

A ball game apparatus comprising a ball-holding device having a ball-receiving cavity, this cavity being open at the bottom and having a sidewall for engaging the ball on one or more sides. There is a flexible, resilient arm connected to the device and located on one side of the cavity opposite a portion of the sidewall. The arm is engagable with a side of the ball when the latter is in the cavity in order to hold the ball therein. Preferably the device includes a strap or arm for connecting the device to a user's hand so that the device is held against the palm of the hand.

10 Claims, 1 Drawing Sheet

TOY FOR BALL GAME

BACKGROUND OF THE INVENTION

This invention relates to ball game apparatus and particularly devices for holding and releasing a ball such as a small, round rubber ball.

It is known to play a ball game that requires very good reflexes in order to play the game well. This game which can be played with two players involves the use of a small ball, usually made of rubber. One player holds the ball in the palm of his hand with his fingers somewhat extended and his palm directed generally downwardly so that the ball is able to fall by simply opening the palm slightly. The object of the other game is for the other player to catch the ball when it is released before the ball hits the ground or pavement. The other player must hold his hand or hands back until the ball is released. An experienced player will try to release the ball from the palm of his hand with very little outward movement so that the other player will have little warning as to when the ball is being released.

A variety of ball holding devices are currently known including various forms of baseball mitts for catching and holding a baseball. However, as far as the applicant is aware no device has been developed for holding a small ball for the above mentioned reflex game. It is desirable to provide a device for such a game, particularly one capable of releasing the ball from the palm of the user's hand with very little outward sign of movement.

U.S. Pat. No. 3,169,019 issued Feb. 9 ,1965 describes a ball game apparatus adapted for holding a ball such as a baseball. The disclosed device comprises a shallow cup having a bottom and annular wall. The bottom and wall are formed as a concave inner surface which radiates in a substantially continuous curve from the bottom to an annular rim. The depth of the cup is sufficient to receive without gripping a small portion of a baseball. A band is provided for attachment of the device to a baseball bat.

It is an object of the present invention to provide a simple and inexpensive ball game apparatus in the form of a ball-holding device with a ball receiving cavity, which device has a flexible, resilient arm located on one side of the cavity. The arm is engagable with the side of small ball when the latter is in the cavity in order to hold the ball therein.

It is a further object of the present invention to provide a ball game apparatus capable of being used in and enhancing a reflex game wherein a small ball is dropped from the palm of a player's hand and must be caught by the other player.

SUMMARY OF THE INVENTION

According to the present invention a ball game apparatus comprises a ball-holding device having a ball-receiving cavity, this cavity being open at the bottom and having a sidewall for engaging the ball on one or more sides. The apparatus includes a flexible, resilient arm connected to the device and located on one side of the cavity opposite at least a portion of the sidewall. The arm is engagable with a side of the ball when the latter is in the cavity in order to hold the ball therein.

The preferred apparatus includes means for connecting the device to the user's hand whereby the device is held against the palm of the hand.

Further features and advantages will become apparent from the following detailed description of a preferred embodiment taken in conjunction with the accompanying drawings.

DETAILED DESCRIPTION OF PREFERRED EMBODIMENT

Figure 1:
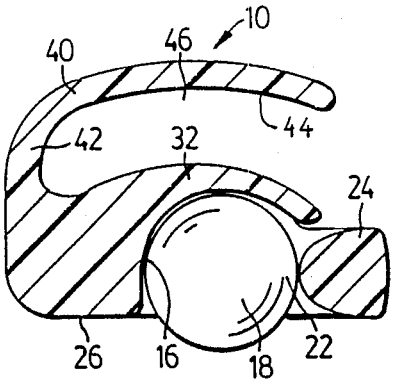
FIG. 1 is a cross-sectional view of a ball game apparatus constructed in accordance with the invention, which view is taken along the line I—I of FIG. 3 and shows the arm of the device pressed against the side of a ball.

The ball game apparatus 10 shown in FIGS. 1 to 4 comprises a ball holding device having a ball-receiving cavity 12. This cavity is open at its bottom 14 and it has a sidewall 16 for engaging a ball 18 on one or more sides. The apparatus 10 includes a flexible, resilient arm 20 connected to the device and located on one side of the cavity 12 opposite at least a portion of the aforementioned sidewall 16. As indicated in FIG. 1, the arm is engagable with a side 22 of the ball when the latter is in the cavity 12 in order to hold the ball therein.

The preferred arm 20 is formed with an inwardly protruding extension 24 which engages a side of the ball during use of the apparatus. The illustrated extension 24 has a rounded end which provides a point contact with the adjacent ball. Preferably the arm is an integral part of the ball-holding device and extends parallel to the bottom 26 of the device. The arm 20 is sized and arranged so as to be easily operable by the user's thumb 28 (see FIG. 5) when the device is held in the palm of his hand 30. A point contact between the end of the arm and the ball is preferred in order to permit an immediate disengagement and ball drop when the pressure on the thumb is released. This contact is provided by the semi-spherical end of the arm.

Figure 5:
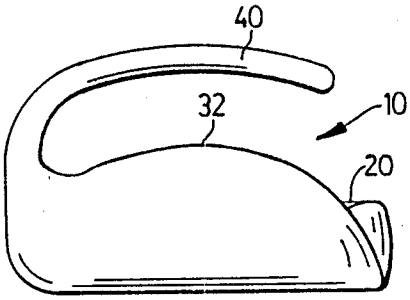
FIG. 5 is a side view taken from the same side as FIGS. 1 and 2.
Figure 6:
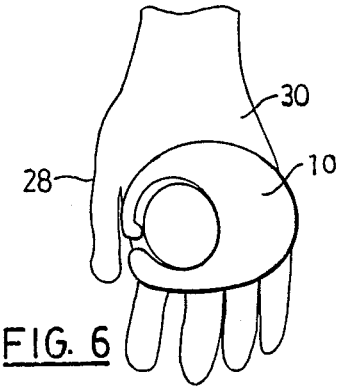
FIG. 6 is a schematic illustration showing how the apparatus of FIG. 1 is held in the palm of a user's hand for playing a reflex game.

As illustrated, the device preferably has a rounded, convex upper surface 32 so that the device is adapted to fit in a cupped hand of a user as illustrated in FIG. 5. It will be appreciated that the device 10 can be manufactured in several different sizes so that the apparatus can be used by small children, older children or adults.

Figure 2:
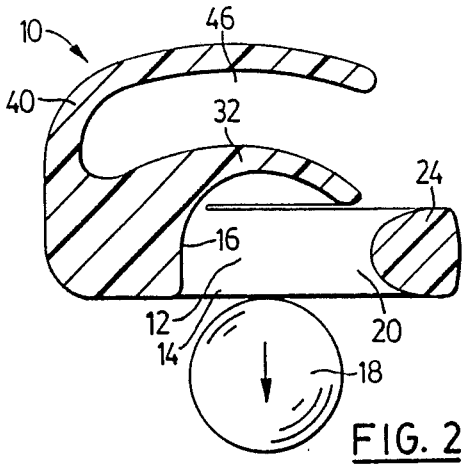
FIG. 2 is a cross-sectional view similar to FIG. 1 but showing the ball after it has been released from the apparatus.
Figure 3:
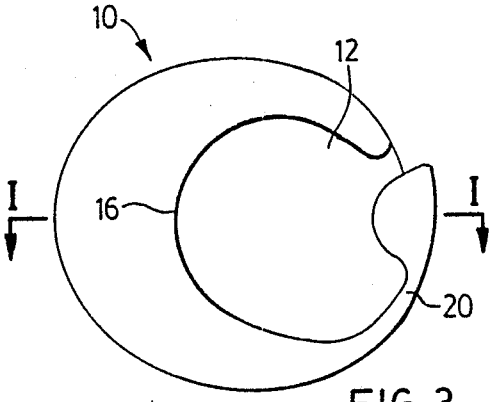
FIG. 3 is a bottom view of the apparatus of FIG. 2.
Figure 4:
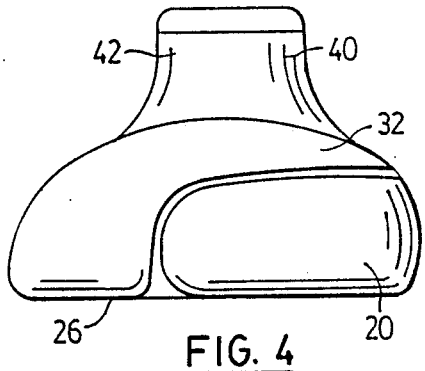
FIG. 4 is a further side view taken from the righthand side of FIG. 1.

Preferably the apparatus 10 comes equipped with means for connecting the device to a user's hand whereby the device is held against the palm of the hand. An integral connector 40 is shown in FIGS. 1, 2 and 4. This connector is joined to the device 10 at one side thereof and extends upwardly at 42 and then across the top of the device at 44. In this way the connector forms a hand-receiving gap 46 between the connector and top surface 32. Instead of the illustrated connector,it will be appreciated by those skilled in the art that flexible straps could also be used to attach the device to a user's hand. Also an elastomeric strap could be used for this purpose.

The ball 18 is sized to fit in the cavity 12. The preferred form of ball 18 is one that is round and is made of elastomeric rubber or rubberlike material. However a hard ball or a ball or object that is not round could also be employed provided the cavity 12 is suitably shaped to accommodate the ball or object to be dropped.

It will be appreciated that the apparatus 10 is simple to use and can be operated without much practice or experience. The apparatus is held in the user's palm and the ball 18 is placed in the cavity 12. The apparatus is arranged so that the arm 20 is disposed adjacent the thumb 28 of the user. A small amount of inward pressure by the thumb will bring the rounded or semi-spherical end of the arm into contact with the side of the ball so that the ball is held in the cavity. The user can then hold his cupped palm in a downward facing position in order to play the aforementioned reflex game. By simply removing the pressure on the arm, the ball 18 will quickly be released. This release operation can be carried out if desired with very little outward sign of movement.

It will be appreciated by those skilled in the art that the described ball game apparatus can be made in a variety of ways and in various configurations without departing from the spirit and scope of this invention. Accordingly all such modifications and changes as fall within the scope of the appended claims are intended to be part of this invention.

I therefore claim:

1. Ball game apparatus comprising a ball-holding device having a ball-receiving cavity, said cavity being open at the bottom and having a sidewall for engaging said ball on one or more sides; and a flexible, resilient arm connected to said device and located on one side of said cavity opposite at least a portion of said sidewall, said arm being engagable with a side of said ball when the latter is in said cavity in order to hold the ball therein.

2. Ball game apparatus according to claim 1 including means for connecting said device to a user's hand whereby said device is held against the palm of said hand.

3. Ball game apparatus according to claim 2 wherein said arm is arranged so as to be operable by the user's thumb when said device is held in the palm of his hand.

4. Ball game apparatus according to claim 3 wherein said arm is formed with an inwardly protruding extension which engages the side of the ball during use of the apparatus.

5. Ball game apparatus according to claim 2 wherein said resilient arm is an integral part of said ball-holding device and extends parallel to the bottom of said device.

6. Ball game apparatus according to claim 4 wherein said resilient arm is an integral part of said ball-holding device and extends parallel to the bottom of said device.

7. Ball game apparatus according to claim 6 including a ball sized to fit in said cavity.

8. Ball game apparatus according to claim 7 wherein said ball is round and made of elastomeric rubber or rubberlike material.

9. Ball game apparatus according to claim 2 wherein said connecting means comprises an integral connector joined to said device at one side thereof and extending upwardly and then across the top of said device, thereby forming a hand-receiving gap between said connector and the top of said device.

10. Ball game apparatus according to claim 1 wherein said device has a rounded convex upper surface so that the device is adapted to fit in a cupped hand of a user.

* * * * *